US008434244B2

(12) United States Patent
Litchfield et al.

(10) Patent No.: US 8,434,244 B2
(45) **Date of Patent: *May 7, 2013**

(54) SUPPORT AND CUSHIONING SYSTEM FOR AN ARTICLE OF FOOTWEAR

(75) Inventors: Paul E. Litchfield, Westborough, MA (US); Matthew J. Montross, Quincy, MA (US); Steven F. Smith, Taunton, MA (US); J. Spencer White, N. Easton, MA (US); Alexander W. Jessiman, Scituate, MA (US)

(73) Assignee: Reebok International Limited, London (GB)

( * ) Notice: Subject to any disclaimer, the term of this patent is extended or adjusted under 35 U.S.C. 154(b) by 157 days.

This patent is subject to a terminal disclaimer.

(21) Appl. No.: 12/351,135

(22) Filed: Jan. 9, 2009

(65) Prior Publication Data

US 2009/0165333 A1 Jul. 2, 2009

Related U.S. Application Data

(63) Continuation of application No. 11/518,941, filed on Sep. 12, 2006, now Pat. No. 7,475,498, which is a continuation of application No. 11/041,225, filed on Jan. 25, 2005, now Pat. No. 7,181,867, which is a continuation of application No. 10/243,825, filed on Sep. 16, 2002, now Pat. No. 6,845,573, which is a continuation of application No. 09/314,893, filed on May 19, 1999, now Pat. No. 6,453,577, which is a continuation of application No. 09/042,078, filed on Mar. 13, 1998, now abandoned, which is a continuation of application No. 08/697,895, filed on Sep. 3, 1996, now Pat. No. 5,771,606, which is a continuation-in-part of application No. 08/599,100, filed on Feb. 9, 1996, now abandoned, which is a continuation of application No. 08/284,646, filed as application No. PCT/US94/00895 on Jan. 26, 1994, now abandoned.

(51) Int. Cl.
*A43B 5/00* (2006.01)
*A43B 13/18* (2006.01)

(52) U.S. Cl.
USPC ..... 36/29; 36/28

(58) Field of Classification Search ..... 36/28, 29, 36/71, 31, 35 B, 93, 153, 15, 103
See application file for complete search history.

(56) References Cited

U.S. PATENT DOCUMENTS

D39,747 S 1/1909 McKenna
945,698 A 1/1910 Conway (Continued)

FOREIGN PATENT DOCUMENTS

CH 213742 12/1941
DE 806 647 7/1949

(Continued)

OTHER PUBLICATIONS

Translation of Japanese Patent Application No. HEI. 6-181802.

(Continued)

*Primary Examiner* — Jila M Mohandesi
(74) *Attorney, Agent, or Firm* — Sterne, Kessler, Goldstein & Fox P.L.L.C.

(57) ABSTRACT

A cushioning member for an article of footwear. The cushioning member is a flexible bladder having a fluidly interconnected heel chamber and forefoot chamber. The bladder is disposed above the sole and beneath the wearer's foot to provided added cushioning to the wearer. The bladder contains air at slightly above ambient pressure and can be formed by thermoforming or by welding two sheets of resilient, flexible material together. A connecting passage fluidly connects the heel chamber and the forefoot chamber. The connecting passage is narrow to control the flow of air between the two chambers.

24 Claims, 9 Drawing Sheets

U.S. PATENT DOCUMENTS 1,029,110 A 6/1912 Drobinski
1,069,001 A 7/1913 Guy
1,193,608 A 8/1916 Poulson
1,272,556 A 7/1918 Steward
1,344,972 A 6/1920 Armour ..... 36/59 A
1,605,985 A 11/1926 Rasmussen
1,711,270 A 4/1929 Little, Jr.
1,979,972 A 11/1934 Guild
2,080,499 A 5/1937 Nathansohn
2,090,881 A 8/1937 Wilson
2,215,463 A 9/1940 Di Mauro
D123,602 S 11/1940 Reeves
D125,657 S 3/1941 Cutler
2,266,476 A 12/1941 Riess
2,318,206 A 5/1943 Eisenlohr
3,120,712 A 2/1964 Menken
3,225,463 A 12/1965 Burnham
3,341,952 A 9/1967 Dassler
3,402,485 A 9/1968 McMorrow
3,469,576 A 9/1969 Smith et al.
D234,930 S 4/1975 Arambasic et al.
4,100,686 A 7/1978 Sgarlato et al.
4,183,156 A 1/1980 Rudy
4,219,945 A * 9/1980 Rudy ..... 36/29
4,312,140 A 1/1982 Reber
4,322,893 A 4/1982 Halrorsen
D265,690 S 8/1982 Famolare, Jr.
D266,798 S 11/1982 Famolare, Jr.
4,358,902 A 11/1982 Cole et al.
D267,288 S 12/1982 Davis
D267,366 S 12/1982 Davis
4,364,188 A 12/1982 Turner et al.
4,391,048 A 7/1983 Lutz
4,446,634 A 5/1984 Johnson et al.
4,458,430 A * 7/1984 Peterson ..... 36/28
4,547,978 A 10/1985 Radford ..... 36/3 B
4,571,852 A 2/1986 Lamarche et al.
4,577,417 A * 3/1986 Cole ..... 36/29
4,653,206 A 3/1987 Tanel
4,754,559 A 7/1988 Cohen
4,763,426 A 8/1988 Polus et al. ..... 36/29
4,779,359 A * 10/1988 Famolare, Jr. ..... 36/29
4,799,319 A 1/1989 Zellweger
4,817,304 A 4/1989 Parker et al.
4,845,861 A 7/1989 Moumdjian
4,856,208 A 8/1989 Zaccaro
4,864,738 A * 9/1989 Horovitz ..... 36/29
4,897,936 A 2/1990 Fuerst
4,910,884 A * 3/1990 Lindh et al. ..... 36/28
4,918,838 A * 4/1990 Chang ..... 36/28
4,936,030 A 6/1990 Rennex
4,999,931 A 3/1991 Vermeulen
5,005,575 A 4/1991 Geri
5,025,575 A 6/1991 Lakic
D323,059 S 1/1992 Hatfield
5,131,174 A 7/1992 Drew et al. ..... 36/35 B
RE34,102 E 10/1992 Cole et al.
5,179,792 A 1/1993 Brantingham ..... 36/29
5,195,249 A 3/1993 Jackson
5,195,257 A 3/1993 Holcomb et al.
5,230,249 A 7/1993 Sasaki et al. ..... 36/29
5,233,767 A 8/1993 Kramer
5,253,435 A 10/1993 Auger et al.
5,255,451 A 10/1993 Tong et al.
D343,051 S 1/1994 Bramani
5,295,314 A 3/1994 Moumdjian
5,311,674 A 5/1994 Santiyanont et al.
5,313,717 A 5/1994 Allen et al.
5,313,718 A 5/1994 McMahon et al.
5,335,382 A 8/1994 Huang
5,337,492 A 8/1994 Anderie et al.
5,343,639 A 9/1994 Kilgore et al.
D351,720 S 10/1994 Kilgore
5,353,459 A 10/1994 Potter et al.
5,353,525 A 10/1994 Grim ..... 36/29
5,367,791 A * 11/1994 Gross et al. ..... 36/31
5,369,896 A * 12/1994 Frachey et al. ..... 36/29
5,375,346 A * 12/1994 Cole et al. ..... 36/29
5,395,674 A 3/1995 Schmidt et al. ..... 428/178
5,406,719 A 4/1995 Potter ..... 36/28
5,416,986 A 5/1995 Cole et al.
5,443,529 A 8/1995 Phillips
5,461,800 A 10/1995 Luthi et al.
5,533,282 A 7/1996 Kataoka et al.
5,545,463 A 8/1996 Schmidt et al.
5,572,804 A 11/1996 Skaja et al. ..... 36/29
5,598,645 A 2/1997 Kaiser
5,625,964 A 5/1997 Lyden et al. ..... 36/29
5,625,965 A 5/1997 Blissett et al.
5,664,341 A 9/1997 Schmidt et al.
5,685,090 A 11/1997 Tawney et al.
5,701,687 A 12/1997 Schmidt et al.
5,706,589 A 1/1998 Marc
5,741,568 A 4/1998 Rudy
5,743,028 A 4/1998 Lombardino
5,755,001 A 5/1998 Potter et al.
D394,939 S 6/1998 Avar
D395,157 S 6/1998 von Conta
5,771,606 A 6/1998 Litchfield et al.
5,784,807 A 7/1998 Pagel
D396,549 S 8/1998 von Conta et al.
5,794,361 A 8/1998 Sadler
5,797,199 A 8/1998 Miller et al.
D398,440 S 9/1998 Rowland
5,802,739 A 9/1998 Potter et al.
5,826,349 A 10/1998 Goss
D400,344 S 11/1998 Avar
D401,043 S 11/1998 Truelsen
5,832,630 A * 11/1998 Potter ..... 36/29
5,842,291 A 12/1998 Schmidt et al.
D405,596 S 2/1999 Aird et al.
5,896,681 A 4/1999 Lin
6,055,747 A 5/2000 Lombardino
D426,947 S 6/2000 Pollastrelli
6,158,149 A 12/2000 Rudy
6,266,897 B1 7/2001 Seydel et al. ..... 36/29
6,305,100 B1 10/2001 Komarnycky et al.
6,487,796 B1 12/2002 Avar et al.
6,505,420 B1 1/2003 Litchfield et al.
6,516,540 B2 2/2003 Seydel et al. ..... 36/29
6,568,102 B1 5/2003 Healy et al. ..... 36/28
D482,852 S 12/2003 Belley et al.
D492,096 S 6/2004 Sanchez et al.
6,745,499 B2 6/2004 Christensen et al.
D501,293 S 2/2005 Bizzo
D504,555 S 5/2005 Urie
6,979,287 B2 12/2005 Elbaz et al.
7,080,467 B2 7/2006 Marvin et al.
7,101,330 B2 9/2006 Elbaz et al.
D532,189 S 11/2006 Truelsen
D553,335 S 10/2007 Amado et al.
D569,084 S 5/2008 Hatfield et al.
D576,394 S 9/2008 Heller
D597,287 S 8/2009 Vestuti et al.
2004/0033864 A1 2/2004 Elbaz et al.
2004/0033874 A1 2/2004 Elbaz et al.
2005/0268490 A1 12/2005 Foxen
2005/0283999 A1 12/2005 Whatley
2008/0242518 A1 10/2008 Elbaz et al.

FOREIGN PATENT DOCUMENTS

DE 820869 11/1951
DE 28 00 359 7/1979
DE 2 919 928 A 11/1980
DE 32 28 017 A1 7/1983
DE 33 20 502 A1 12/1983
DE 92 10 113.5 11/1992
DE 92 15 481.6 4/1993
EP 0095357 11/1983
EP 0 399 332 B1 12/1993
EP 0 714 613 1/1998
EP 1120056 A2 8/2001
FR 720257 2/1932
FR 2614510 11/1988
FR 2663208 12/1991
GB 338266 11/1930
GB 2 032 761 A 5/1980

| | | | |
|---|---|---|---|
| GB | 2039717 | | 8/1980 |
| GB | 1 598 012 | | 9/1981 |
| GB | 2085278 | | 4/1982 |
| GB | 2114425 | | 8/1983 |
| GB | 2201082 | | 8/1988 |
| GB | 2 225 212 | A | 5/1990 |
| GB | 2 273 037 | A | 6/1994 |
| JP | 6-181802 | | 7/1994 |
| WO | WO 89/06500 | | 7/1989 |
| WO | WO 91/11931 | A1 | 8/1991 |
| WO | WO 91/16831 | | 11/1991 |
| WO | WO 93/12685 | | 7/1993 |
| WO | WO 93/14659 | | 8/1993 |
| WO | WO 94/09661 | | 5/1994 |
| WO | WO 95/20332 | | 8/1995 |
| WO | WO 98/09546 | | 3/1998 |
| WO | WO 2004/016321 | A2 | 2/2004 |
| WO | WO 2004/016321 | A3 | 2/2004 |

OTHER PUBLICATIONS

Photographs of Nike Air Force 180 shoe. Nike Air Force 180 shoes were on sale prior to Nov. 1993.

Brochure of the Nike Air Force 180 shoe. Brochure was included with shoes on sale prior to Nov. 1993.

U.S. Appl. No. 07/919,952, filed Jul. 27, 1992, Edington et al.

Co-pending U.S. Appl. No. 12/416,698 to McInnis et al., filed Apr. 1, 2009.

The Times, Body + Soul article, pp. 7-8, Sep. 26, 2009.

Apos, Less Pain, More Function article, 12 pages, copyright 2008.

Flexyboots article, retrieved on Oct. 6, 2009 from http://www.flexyboot.com, 2 pages.

Draft Flexyboots BmbH Patent Application dated Aug. 20, 2008, retrieved on Jun. 26, 2009 from http://www.flexiboots.ch/Patent.pdf, 42 pages.

Reebok Fall 2002 Footwear Catalog, p. 14, showing the U-Shuffle DMX shoe.

Reebok Third Quarter 2003 Footwear Catalog, p. 17, showing the Stimulus DMX shoe, and pp. 16 and 41, showing the Court Macabee II DMX shoe.

Reebok Spring 2005 Footwear catalog, p. 30, showing the Sportcentric DMX Max shoe, p. 31, showing the Destination DMX shoe, and pp. 32 and 52, showing the Trail DMX Max and Sporterra DMX Walk shoes.

Reebok Third Quarter 2005 Footwear catalog, p. 50, showing the Sportcentric DMX Max shoe.

Reebok First Quarter 2007 Footwear Catalog, pp. 16 and 53, showing the Voyage Mid III and Voyage Low III shoes.

Co-pending U.S. Appl. No. 29/339,457 to Vestuti et al., filed Jun. 30, 2009.

Co-pending U.S. Appl. No. 12/571,327 to Litchfield et al., filed Sep. 30, 2009.

Extended European Search Report for Application No. EP 09179450.3, Applicant: Reebok International Ltd., mailed Aug. 2, 2010.

DMX shoe, 1994.

* cited by examiner 1312
1304
1312
1402
1314
1002
606
706
706
102
604
702
702

1310
14
1308
1304
1306
1302
1314
1002
606
102
604
14

SUPPORT AND CUSHIONING SYSTEM FOR AN ARTICLE OF FOOTWEAR

CROSS-REFERENCE TO RELATED APPLICATIONS

This application is a continuation of U.S. application Ser. No. 11/518,941, filed Sep. 12, 2006; now U.S. Pat. No 7,475,498, issued Jan. 13, 2009; which is a continuation of U.S. application Ser. No. 11/041,225, filed Jan. 25, 2005, now U.S. Pat. No. 7,181,867, issued Feb. 27, 2007; which is a continuation of U.S. application Ser. No. 10/243,825, filed Sep. 16, 2002, now U.S. Pat. No. 6,845,573, issued Jan. 25, 2005; which is a continuation of U.S. application Ser. No. 09/314,893, filed May 19, 1999, now U.S. Pat. No. 6,453,577, issued Sep. 24, 2002; which is a continuation of U.S. application Ser. No. 09/042,078, filed Mar. 13, 1998, now abandoned; which is a continuation of U.S. application Ser. No. 08/697,895, filed Sep. 3, 1996, now U.S. Pat. No. 5,771,606, issued Jun. 30, 1998, the disclosures of which are incorporated herein in their entirety by reference thereto.

BACKGROUND OF THE INVENTION

1. Field of the Invention

This invention relates generally to footwear, and more particularly to an article of footwear having a system for providing cushioning and support for the comfort of the wearer.

2. Related Art

One of the problems associated with shoes has always been striking a balance between support and cushioning. Throughout the course of an average day, the feet and legs of an individual are subjected to substantial impact forces. Running, jumping, walking and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, during a typical walking or running stride, the achilles tendon and the arch stretch and contract, storing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. This results in discomfort for the wearer which diminishes the incentive for further athletic activity. Equally important, inadequately cushioned footwear can lead to injuries such as blisters, muscle, tendon and ligament damage, and bone stress fractures. Improper footwear can also lead to other ailments, including back pain.

Proper footwear should complement the natural functionality of the foot, in part by incorporating a sole (typically, an outsole, midsole and insole) which absorbs shocks. However, the sole should also possess enough resiliency to prevent the sole from being "mushy" or "collapsing," thereby unduly draining the energy of the wearer.

In light of the above, numerous attempts have been made over the years to incorporate into a shoe means for providing improved cushioning and resiliency to the shoe. For example, attempts have been made to enhance the natural elasticity and energy return of the foot by providing shoes with soles which store energy during compression and return energy during expansion. These attempts have included using compounds such as ethylene vinyl acetate (EVA) or polyurethane (PU) to form midsoles. However, foams such as EVA tend to break down over time, thereby losing their resiliency.

Another concept practiced in the footwear industry to improve cushioning and energy return has been the use of fluid-filled devices within shoes. These devices attempt to enhance cushioning and energy return by transferring a pressurized fluid between the heel and forefoot areas of a shoe. The basic concept of these devices is to have cushions containing pressurized fluid disposed adjacent the heel and forefoot areas of a shoe. The overriding problem of these devices is that the cushioning means are inflated with a pressurized gas which is forced into the cushioning means, usually through a valve accessible from the exterior of the shoe.

There are several difficulties associated with using a pressurized fluid within a cushioning device. Most notably, it may be inconvenient and tedious to constantly adjust the pressure or introduce a fluid to the cushioning device. Moreover, it is difficult to provide a consistent pressure within the device thereby giving a consistent performance of the shoes. In addition, a cushioning device which is capable of holding pressurized gas is comparatively expensive to manufacture. Further, pressurized gas tends to escape from such a cushioning device, requiring the introduction of additional gas. Finally, a valve which is visible to the exterior of the shoe negatively affects the aesthetics of the shoe; and increases the probability of the valve being damaged when the shoe is worn.

A cushioning device which, when unloaded contains air at ambient pressure provides several benefits over similar devices containing pressurized fluid. For example, generally a cushioning device which contains air at ambient pressure will not leak and lose air, because there is no. pressure gradient in the resting state. The problem with many of these cushioning devices is that they are either too hard or too soft. A resilient member that is too hard may provide adequate support when exerting pressure on the member, such as when running. However, the resilient member will likely feel uncomfortable to the wearer when no force is exerted on the member, such as when standing. A resilient member that is too soft may feel cushy and comfortable to a wearer when no force is exerted on the member, such as when standing or during casual walking. However, the member will likely not provide the necessary support when force is exerted on the member, such as when running. Further, a resilient member that is too soft may actually drain energy from the wearer.

Accordingly, what is needed is a shoe which incorporates a cushioning system including a means to provide resilient support to the wearer during fast walking and running, and to provide adequate cushioning to the wearer during standing and casual walking.

SUMMARY OF THE INVENTION

To achieve the foregoing and other objects, and in accordance with the purposes of the present invention as embodied and broadly described herein, the article of footwear of the present invention comprises a sole and a resilient support and cushioning system. The system of the present invention includes a resilient insert member and a bladder disposed within an article of footwear.

In one embodiment, the resilient insert includes a plurality of heel chambers, a plurality of forefoot chambers and a central connecting passage fluidly interconnecting the chambers. The resilient insert is preferably blow molded from an elastomeric material, and may contain air at ambient pressure or slightly above ambient pressure. The resilient insert is placed between an outsole and a midsole of the article of footwear.

In one embodiment, the central connecting passage contains an impedance means to restrict the flow of air between the heel chambers and the forefoot chambers. Thus, during heel strike, the air is prevented from rushing out of the heel chambers all at once. Thus, the air in the heel chambers provides support and cushioning to the wearer's foot during heel strike.

The bladder of the present invention includes a heel chamber, a forefoot chamber and at least one connecting passage fluidly interconnecting the two chambers. The bladder is disposed above the midsole of the article of footwear, and provides added cushioning to the wearer's foot. In one embodiment, the bladder is thermoformed from two sheets of resilient, non-permeable elastomeric material such that the bladder contains air at slightly above ambient pressure.

In use, the bladder provides cushioning to the wearer's foot while standing or during casual walking. The resilient insert provides added support and cushioning to the wearer's foot during fast walking and running. In an alternate embodiment, for example, for use as a high performance shoe, the article of footwear may contain only the resilient insert disposed between the midsole and outsole. In another alternate embodiment, for example, for use as a casual shoe, the article of footwear may contain only the bladder disposed above the midsole.

When stationary, the foot of a wearer is cushioned by the bladder. When the wearer begins a stride, the heel of the wearer's foot typically impacts the ground first. At this time, the weight of the wearer applies downward pressure on the heel portion of the resilient insert, causing the heel chambers to be forced downwardly.

The heel chambers of the resilient insert are connected via periphery passages. These passages essentially divide the heel portion into a medial region and a lateral region so that the resilient insert is designed geometrically to help compensate for the problem of pronation, the natural tendency of the foot to roll inwardly after heel impact. During a typical gait cycle, the main distribution of forces on the foot begins adjacent the lateral side of the heel during the "heel strike" phase of the gait, then moves toward the center axis of the foot in the arch area, and then moves to the medial side of the forefoot area during "toe-off." The configuration of the passages between the heel chambers ensures that the air flow within the resilient insert complements such a gait cycle.

Thus, the downward pressure resulting from heel strike causes air within the resilient insert to flow from the medial region into the lateral region. Thus, the medial region is cushioned first to prevent the wearer's foot from rolling inwardly. Further compression of the heel portion causes the air in the lateral region to be forced forwardly, through the central connecting passage and into the forefoot portion of the resilient insert.

The flow of air into the forefoot portion causes the forefoot chambers to expand, which slightly raises the forefoot or metatarsal area of the foot. When the forefoot of the wearer is placed upon the ground, the expanded forefoot chambers help cushion the corresponding impact forces. As the weight of the wearer is applied to the forefoot, the downward pressure caused by the impact forces causes the forefoot chambers to compress, forcing the air therein to be thrust rearwardly through the central connecting passage into the heel portion.

After "toe-off," no downward pressure is being applied to the article of footwear, so the air within the resilient insert should return to its normal state. Upon the next heel strike, the process is repeated.

Disclosed herein, there is also provided an article of footwear comprising a sole having a forefoot portion and a heel portion, the sole comprising a midsole, an intermediate sole, and a ground contacting surface. An indentation is formed in the midsole. A portion of the intermediate sole is disposed in the indentation and a portion of the intermediate sole extends from the midsole such that a forefoot bulge is disposed in the forefoot portion of the ground contacting surface and a heel bulge is disposed in the heel portion of the ground contacting surface. In one embodiment, the intermediate sole comprises a resilient insert having at least one forefoot chamber and at least one heel chamber in fluid communication with the at least one forefoot chamber.

In light of the foregoing, it will be understood that the system of the present invention provides a variable, non-static cushioning, in that the flow of air within the bladder and the resilient insert complements the natural biodynamics of an individual's gait.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

A preferred embodiment of the present invention is now described with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in a variety of other devices and applications.

Another cushioning device is described in U.S. patent application Ser. No. 08/599,100, filed Feb. 9, 1996, for a "Resilient Insert For An Article of Footwear," now pending, the disclosure of which is incorporated herein by reference, and which is a file wrapper continuation of U.S. patent application Ser. No. 08/284,646, filed Aug. 11, 1994, now abandoned, which claims priority under 35 U.S.C. §119 to International Application Number PCT/US94/00895, filed Jan. 26, 1994.

Referring now to FIGS. 1-5, a resilient insert 102 is shown. Resilient insert 102 provides continuously modifying cushioning to an article of footwear, such that a wearer's stride forces air within resilient insert 102 to move in a complementary manner with respect to the stride.

Figure 1:
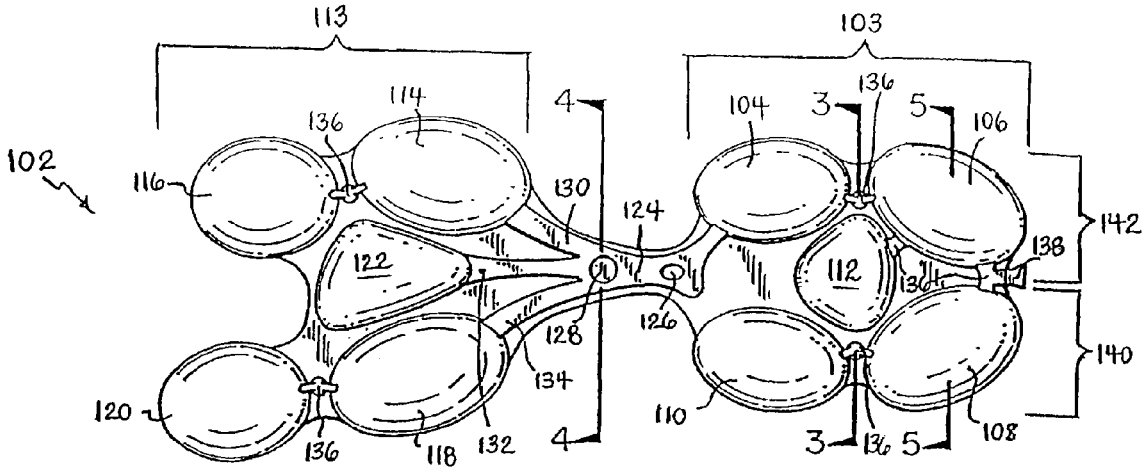
FIG. 1 is a top plan view of a resilient insert in accordance with the present invention.
Figure 2:
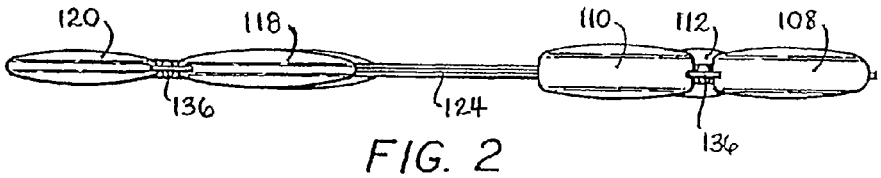
FIG. 2 is a medial side view of the resilient insert of FIG. 1.

FIG. 1 is a top plan view of resilient insert 102 in accordance with the present invention. However, FIG. 1 may in fact be either a top or bottom plan view, as the top and bottom of resilient insert 102 are substantially the same. FIG. 2 is a medial side view of resilient insert 102.

Resilient insert 102 is a three-dimensional structure formed of a suitably resilient material so as to allow resilient insert 102 to compress and expand while resisting breakdown. Preferably, resilient insert 102 may be formed from a thermoplastic elastomer or a thermoplastic olefin. Suitable materials used to form resilient insert 102 may include various ranges of the following physical properties:

| | | Preferred Lower Limit | Preferred Upper Limit |
|---|---|---|---|
| Density (Specific Gravity in g/cm$^3$) | | 0.80 | 1.35 |
| Modulus @ 300% Elongation (psi) | | 1,000 | 6,500 |
| Permanent Set @ 200% Strain (%) | | 0 | 55 |
| Compression Set 22 hr/23° C. | | 0 | 45 |
| Hardness | Shore A | 70 | — |
| | Shore D | 0 | 55 |
| Tear Strength (KN/m) | | 60 | 600 |
| Permanent Set at Break (%) | | 0 | 600 |

Many materials within the class of Thermoplastic Elastomers (TPEs) or Thermoplastic Olefins (TPOs) can be utilized to provide the above physical characteristics. Thermoplastic Vulcanates (such as SARLINK from PSM, SANTAPRENE from Monsanto and KRATON from Shell) are possible materials due to physical characteristics, processing and price. Further, Thermoplastic Urethanes (TPU's), including a TPU available from Dow Chemical Company under the tradename PELLETHANE (Stock No. 2355-95AE), a TPU available from B.F. Goodrich under the tradename ESTANE and a TPU available from BASF under the tradename ELASTOLLAN provide the physical characteristics described above. Additionally, resilient insert 102 can be formed from natural rubber compounds. However, these natural rubber compounds currently cannot be blow molded as described below.

The preferred method of manufacturing resilient insert 102 is via extrusion blow molding. It will be appreciated by those skilled in the art that the blow molding process is relatively simple and inexpensive. Further, each element of resilient insert 102 of the present invention is created during the same preferred molding process. This results in a unitary, "one-piece" resilient insert 102, wherein all the unique elements of resilient insert 102 discussed herein are accomplished using the same mold. Resilient insert 102 can be extrusion blow molded to create a unitary, "one-piece" component, by any one of the following extrusion blow molding techniques: needle or pin blow molding with subsequent sealing, air entrapped blow molding, pillow blow molding or frame blow molding. These blow molding techniques are known to those skilled in the relevant art.

Alternatively, other types of blow molding, such as injection blow molding and stretch blow molding may be used to form resilient insert 102. Further, other manufacturing methods can be used to form resilient insert 102, such as thermoforming and sealing, or vacuum forming and sealing.

Resilient insert 102 is a hollow structure preferably filled with ambient air. In one embodiment, resilient insert 102 is impermeable to air; i.e., hermetically sealed, such that it is not possible for the ambient air disposed therein to escape upon application of force to resilient insert 102. Naturally, diffusion may occur in and out of resilient insert 102. The unloaded pressure within resilient insert 102 is preferably equal to ambient pressure. Accordingly, resilient insert 102 retains its cushioning properties throughout the life of the article of footwear in which it is incorporated. If resilient insert 102 is formed by air entrapment extrusion blow molding, the air inside resilient insert 102 may be slightly higher than ambient pressure (e.g., between 1-5 psi above ambient pressure).

As can be seen with reference to FIG. 1, resilient insert 102 is preferably a unitary member comprising three distinct components: a heel portion 103, a forefoot portion 113, and a central connecting passage 124. Heel portion 103 is generally shaped to conform to the outline of the bottom of an individual's heel, and is disposed beneath the heel of a wearer when resilient insert 102 is incorporated within a shoe. In one embodiment, as shown in FIG. 1, heel portion 103 includes a plurality of peripheral heel chambers 104, 106, 108, 110 and a central heel air chamber 112.

Disposed opposite heel portion 103 is forefoot portion 113. Forefoot portion 113 is generally shaped to conform to the forefoot or metatarsal area of a foot, and is disposed beneath a portion of the forefoot of a wearer when incorporated within a shoe. In one embodiment, as shown in FIG. 1, forefoot portion 113 includes a plurality of peripheral forefoot chambers 114, 116, 118, 120 and a central forefoot air chamber 122. Preferably, the volume of air within the chambers of forefoot portion 113 is substantially the same as or slightly less than the volume of air within the chambers of heel portion 103.

As shown in FIG. 1, impedance means 126 and 128 are disposed within central connecting passage 124. Impedance means 126 and 128 provide a restriction in central connecting passage 124 to restrict the flow of air through central connecting passage 124.

In one embodiment, impedance means 126 and 128 comprise a convolution of connecting passage 124 formed by restriction walls 129 (shown in detail in FIG. 4) placed in central connecting passage 124. In FIG. 1 impedance means 126 is shown as being substantially oval-shaped, and impedance means 128 is shown as being substantially circular. However, impedance means 126 and 128 may comprise numerous shapes or structures. For example, in another embodiment, the impedance means could be provided by a pinch-off of the material or increased wall thickness of the material.

Impedance means 126 and 128 prevent air from rushing out of heel chambers 104-112 upon heel strike wherein pressure is increased in heel portion 103. The shape or structure of impedance means 126 and 128 determines the amount of air that is permitted to pass through central connecting passage 124 at any given time.

The different structures of the impedance means of the present invention are accomplished during the preferred blow-molding manufacturing process described above. Accordingly, no complicated or expensive valve means need be attached to resilient insert 102. Rather, the shape of impedance means 126 and 128 is determined by the same mold used to form the remainder of resilient insert 102.

As noted above, the shape of impedance means 126 and 128 will affect the rate and character of air flow within resilient insert 102, in particular between heel portion 103 and forefoot portion 113 thereof.

Central connecting passage 124 comprises an elongated passage which connects heel portion 103 to forefoot portion 113. Central connecting passage 124 has a first branch 130, connected to forefoot air chamber 114, a second branch 132, connected to central forefoot air chamber 122, and a third branch 134, connected to forefoot air chamber 118. These separate branches 130-134 allow air to flow directly into forefoot portion 113 via three separate chambers to distribute air to forefoot chambers 114-122. Further, central connecting passage 124 is directly connected to heel air chamber 104 in heel portion 103.

In an alternate embodiment of resilient insert 102, heel portion 103 and forefoot portion 113 may each include only one air chamber. In this embodiment, central connecting passage 124 has only one branch to connect the heel chamber with the forefoot chamber. Similarly, it would be apparent to one skilled in the relevant art to alter the number of air chambers in heel portion 103 and forefoot portion 113 to accommodate different conditions and/or gait patterns. As such, the number of branches of central connecting passage 124 would also vary accordingly to distribute air to the chambers in forefoot portion 113.

Heel chambers 104-112 are fluidly interconnected via periphery passages 136. Periphery passages 136 allow air to transfer between chambers 104-112 in heel portion 103. Similarly, forefoot chambers 114 and 116 and forefoot chambers 118 and 120 are fluidly interconnected via periphery passages 136, as shown in FIG. 1. Periphery passages 136 in heel portion 103 essentially divide heel portion 103 into two regions: a medial region 140 and a lateral region 142. Medial region 140 includes heel chambers 108 and 110, while lateral region includes heel chambers 104, 106 and 112.

A sealed molding port 138 is disposed adjacent the rear of heel portion 103, indicating the area where a molding nozzle was positioned during blow molding. In an alternate embodiment, the molding nozzle can be positioned at the top of forefoot portion 113 for blow molding resilient insert 102. Port 138 may easily be removed (such as by cutting or shaving) during the manufacturing process.

As previously indicated, resilient insert 102 is formed of a suitably resilient material so as to enable heel and forefoot portions 103, 113 to compress and expand. Central connecting passage 124 is preferably formed of the same resilient material as the two oppositely-disposed portions adjacent its ends.

As shown in FIG. 2, heel chambers 104-112 are slightly larger in volume, than forefoot chambers 114-122. This configuration provides heel chambers 104-112 with a larger volume of air for support and cushioning of the wearer's foot. Since typically during walking and running, the heel of the wearer receives a larger downward force during heel strike, than the forefoot receives during "toe-off," the extra volume of air in heel chambers 104-112 provides the added support and cushioning necessary for the comfort of the wearer.

Figure 3:
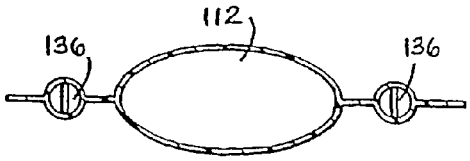
FIG. 3 is a cross-sectional view taken along line 3-3 of FIG. 1.

FIG. 3 is a cross-section view of resilient insert 102 taken along line 3-3 of FIG. 1. In particular, periphery passages 136 and central heel air chamber 112 are shown in FIG. 3. In one embodiment, central heel air chamber is triangular in shape, as opposed to the more oval shape of heel chambers 104-110. Further, central heel air chamber 112 is slightly flatter than the remaining heel chambers 104-110. This is because the center of the wearer's heel does not typically encounter as much of a downward force upon heel strike as the outer edges of the wearer's heel, and thus the center of the heel does not require as much cushioning and support.

Figure 4:
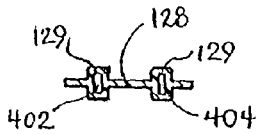
FIG. 4 is a cross-sectional view taken along line 4-4 of FIG. 1.

FIG. 4 is a cross-section view of resilient insert 102 taken along line 4-4 of FIG. 1. In particular, impedance means 128 is shown in FIG. 3. As shown, restriction walls 129 of impedance means 128 form barriers in central connecting passage 124. The sides of central connecting passage 124 and impedance means 128 combine to form narrow passages 402 and 404 on either side of impedance means 128. Narrow passages 402 and 404 slow the flow of air between heel portion 103 and forefoot portion 113 so that upon heel strike, the air in heel portion 103 gradually flows into forefoot portion 113 to provide adequate support and cushioning to the wearer's foot.

As shown in FIG. 1, once the air passes impedance means 128, it enters forefoot portion 113 via three branches 130-134. The air is then distributed via three branches 130-134 to forefoot chambers 114-122.

Figure 5:
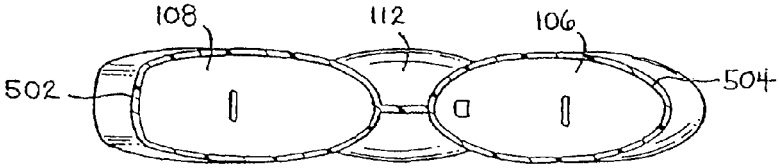
FIG. 5 is a cross-sectional view taken along line 5-5 of FIG. 1.

FIG. 5 shows a cross-sectional view of resilient insert 102 taken along line 5-5 of FIG. 1. In particular, FIG. 5 shows heel chambers 106 and 108. As shown, heel air chamber 108, disposed in medial region 140, has a squared edge 502. Similarly, heel air chamber 110 (not visible in FIG. 5) also has a squared edge. Squared edge 502 provides extra stiffness to heel chambers 108 and 110 so that these chambers are not compressed as easily during heel strike as the remaining heel chambers 104, 106 and 112. In particular, squared edges 502 provide added strength to the corners of chambers 108 and 110 so that they are harder to collapse during heel strike.

Heel chambers 108 and 110 thus provide added support to the wearer's foot in medial region 140 to address the problem of pronation, the natural tendency of the foot to roll inwardly after heel impact. During a typical gait cycle, the main distribution of forces on the foot begins adjacent the lateral side of the heel during the "heel strike" phase of the gait, then moves toward the center axis of the foot in the arch area, and then moves to the medial side of the forefoot area during "toe-off." Heel chambers 108 and 110 on medial portion 140 address the problem of pronation by preventing the wearer's foot from rolling to the medial side during toe-off by providing the chambers on medial portion 140 with squared edge 502.

Heel air chamber 106, disposed in lateral region 142, has a rounded edge 504. Similarly, heel air chamber 104 (not visible in FIG. 5) also has a rounded edge. Rounded edge 504 allows heel chambers 104 and 106 to gradually collapse under pressure from the heel strike so that air from heel portion 103 begins to flow into central connecting passage 124 and forefoot portion 113. Because lateral portion 142 of heel portion 103 does not require as much support as medial portion 140, rounded edge 504 of heel chambers 104 and 106 provides adequate support to the wearer during heel strike.

Figures 6, 7:
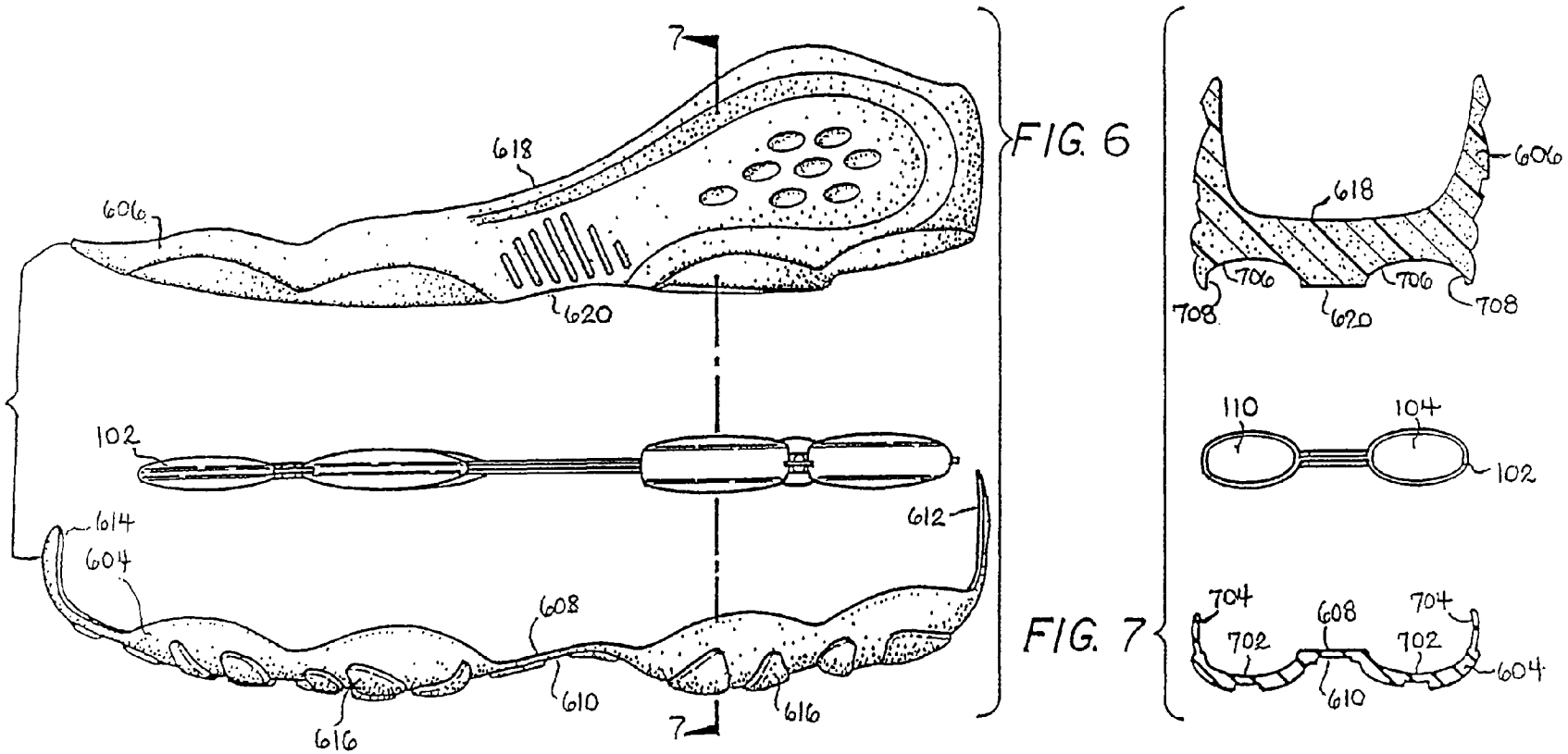
FIG. 6 is an exploded view of one possible interrelationship of an outsole, resilient insert and midsole in accordance with the present invention.
FIG. 7 is a cross-sectional view taken along line 7-7 of FIG. 6.

In order to appreciate the manner in which resilient insert 102 may be incorporated within a shoe, FIGS. 6 and 7 disclose one possible manner of incorporation. FIG. 6 is an exploded view showing resilient insert 102 disposed within a sole 602. FIG. 7 is a cross-sectional view of sole 602 taken along line 7-7 of FIG. 6. Sole 602 includes an outsole 604 and a midsole 606. Thus, in the embodiment shown in FIG. 6, resilient insert 102 is shown disposed between outsole 604 and midsole 606. Outsole 604 and midsole 606 are described below with reference to FIGS. 6-9.

Figure 8:
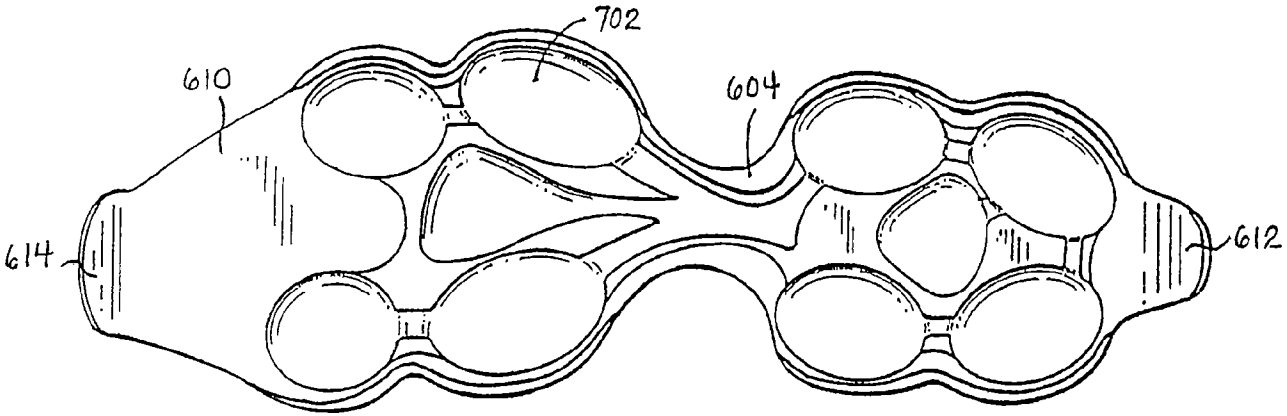
FIG. 8 is a bottom plan view of the outsole of the present invention, as shown in FIG. 6.

Outsole 604 has an upper surface 608 and a lower surface 610. Further, outsole 604 has a rear tab 612 and a front tab 614. As shown in FIG. 7, upper surface 608 has concave indentations 702 formed therein having upturned side edges 704. Indentations 702 are formed to receive resilient insert 102. Upturned side edges 704 cover the edges of resilient member 102 so that the exterior of resilient insert 102 is not physically exposed to the wearer's surroundings. Further, rear tab 612 and front tab 614 are attached to midsole 606 to prevent the front or rear of resilient insert 102 from being exposed. In one embodiment, outsole 604 is made from a clear crystalline rubber material so that resilient insert 102 is visible to the wearer through outsole 604. Outsole 604 has tread members 616 on lower surface 610. Further, as shown in FIG. 8, outsole 604 has convex indentations 702 on lower surface 610, such that indentations 702 contact the ground during use.

Figure 9:
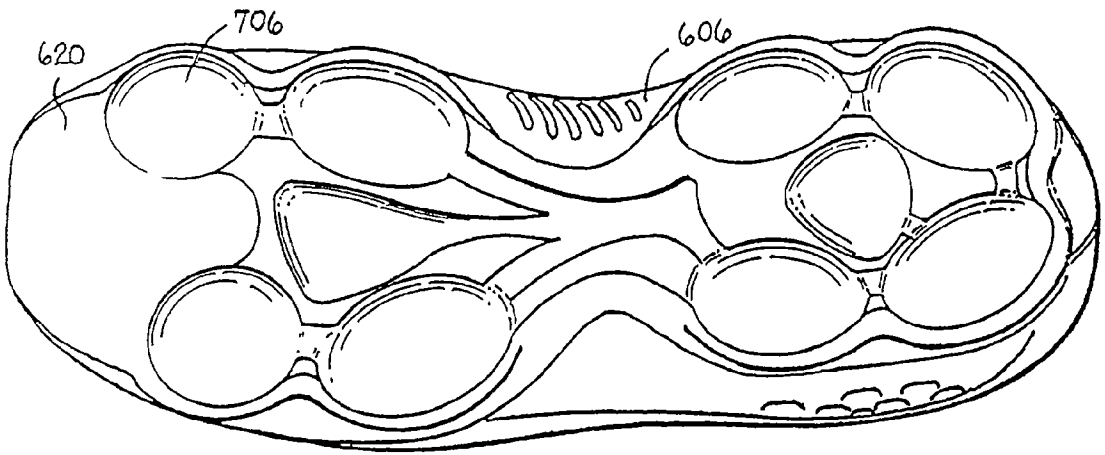
FIG. 9 is a bottom plan view of the midsole of the present invention, as shown in FIG. 6.

Midsole 606 has an upper surface 618 and a lower surface 620. As shown in FIGS. 7 and 9, lower surface 620 of midsole 606 has concave indentations 706 formed therein. Indentations 706 are formed to receive resilient insert 102. Midsole 606 also has side edges 708, as shown in FIG. 7. In one embodiment, midsole 606 is made from EVA foam, as is conventional in the art.

Although in the illustrated embodiment of FIG. 6 resilient insert 102 is disposed between outsole 604 and midsole 606, those skilled in the relevant art will appreciate that resilient insert 102 may alternatively be disposed within a cavity formed within midsole 606.

Figure 10:
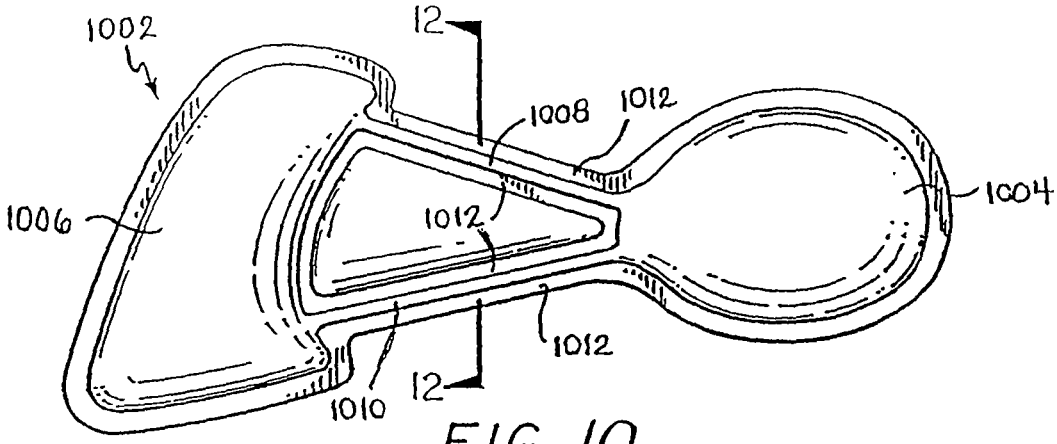
FIG. 10 is a top plan view of a bladder of the present invention.
Figure 11:
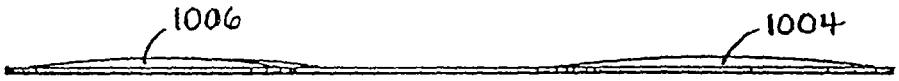
FIG. 11 is a medial side view of the bladder of FIG. 10.
Figure 12:
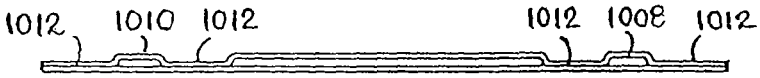
FIG. 12 is a cross-sectional view taken along line 12-12 of FIG. 10.

FIGS. 10-12 show a bladder 1002 of the present invention. Bladder 1002 has a rear air chamber 1004 and a front air chamber 1006. In one embodiment, bladder 1002 is manufactured by thermoforming two sheets of plastic film. Each sheet of film used in the thermoforming process is between approximately 6-25 mils (0.15-0.60 mm). In the preferred embodiment, sheets of film between 10-15 mils (0.25-0.40 mm) are preferred. FIG. 10 shows weld lines 1012 created by the thermoforming manufacturing process. Bladder 1002 is made from a relatively soft material, such as urethane film having a hardness of Shore A 80-90, so that bladder 1002 provides added cushioning to the wearer.

During the thermoforming process, weld lines 1012 form connecting passages 1008 and 1010 which fluidly connect rear and front chambers 1004 and 1006. Connecting passages 1008 and 1010 are preferably narrow, approximately 0.030 inch (0.8 mm)-0.050 inch (1.3 mm) in width and 0.030 inch (0.8 mm)-0.050 inch (1.3 mm) in height, to control the rate of air flow between rear air chamber 1004 and front air chamber 1006 during use. In another embodiment, bladder 1002 may be formed by RF welding, heat welding or ultrasonic welding of the urethane film material, instead of thermoforming.

Bladder 1002 is a hollow structure preferably filled with air at slightly above ambient pressure. (e.g., at 1-5 psi above ambient pressure). In one embodiment, bladder 1002 is impermeable to air; i.e., hermetically sealed, such that it is not possible for the air disposed therein to escape upon application of force to bladder 1002. Naturally, diffusion may occur in and out of bladder 1002. However, because bladder 1002 contains air at only slightly above ambient pressure, it retains its cushioning properties throughout the life of the article of footwear in which it is incorporated.

FIG. 11 shows a medial side view of bladder 1002. As shown in FIGS. 11 and 12, the portion of bladder 1002 disposed between connecting passages 1008 and 1010, is relatively flat. Thus, bladder 1002 provides cushioning for the heel and forefoot portions of the wearer's feet. FIG. 12 shows a cross-sectional view of bladder 1002 taken along line 12-12 of FIG. 10. In particular, FIG. 12 shows connecting passages 1008 and 1010 formed by weld lines 1012.

Figures 13, 14:
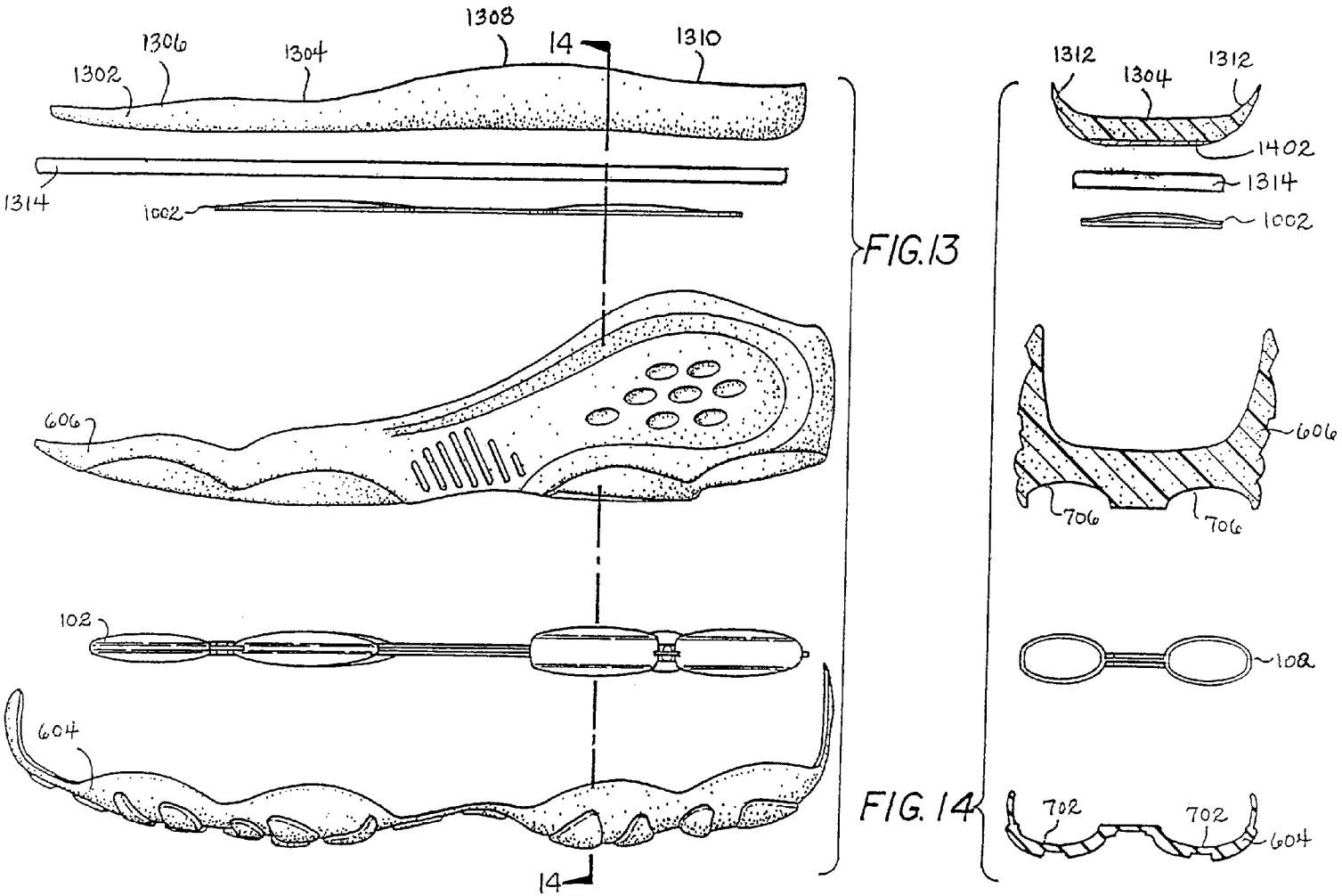
FIG. 13 is an exploded view of an alternate interrelationship of the outsole, resilient insert, midsole and bladder in accordance with the present invention.
FIG. 14 is a cross-sectional view taken along line 14-14 of FIG. 13.

In order to appreciate the manner in which resilient insert 102 and bladder 1002 may cooperate to provide both support and cushioning within a shoe, FIGS. 13 and 14 disclose one possible manner of incorporation of these members within the shoe. FIG. 13 is an exploded view showing resilient insert 102 and bladder 1002 as disposed within a shoe. FIG. 14 is a cross-sectional view of the shoe taken along line 14-14 of FIG. 13. Thus, in the embodiment shown in FIG. 13, resilient insert 102 is shown disposed between outsole 604 and midsole 606. FIG. 14 shows the indentations formed in outsole 604 and midsole 606 to accommodate resilient insert 102, as described above.

Bladder 1002 is shown disposed above midsole 606 and below a lasting board 1314 and a sockliner 1302. Lasting board 1314 may be made from a thick paper material, fibers or textiles, and is disposed between sockliner 1302 and bladder 1002. Sockliner 1302 includes a foot supporting surface 1304 having a forefoot region 1306, an arch support region 1308 and a heel region 1310. A peripheral wall 1312 extends upwardly from and surrounds a portion of foot supporting surface 1304.

Disposed on the underside of sockliner 1302 is a moderating surface made from a stiff material comprising moderator 1402 (shown in FIG. 14). Moderator 1402 acts as a stiff "plate" between bladder 1002 and the foot of a wearer. Preferably, moderator 1402 is formed of material having a hardness of Shore A 75-95 or Shore C 55-75. Potential materials used to form moderator 1402 include EVA, PU, polypropylene, polyethylene, PVC, PFT, fiberboard and other thermoplastics which fall within the aforementioned hardness range. The relatively stiff material acts as a moderator for foot strike and diffuses impact forces evenly upon bladder 1002 and resilient insert 102, thereby reducing localized pressures.

In an alternate embodiment, instead of making moderator 1402 out of a separate material, lasting board 1314 could act as a moderator. In another embodiment, sockliner 1302 may serve as a moderator. In still another embodiment, moderator 1402 may be made from a combination of sockliner 1302, lasting board 1314 and/or one or more of the materials described above having a sufficient hardness to act as a moderator. Thus, it will be appreciated by those skilled in the art that moderator may comprise any structure that accomplishes the above-mentioned moderating function, including part of a midsole, outsole, insole, or a combination of these elements.

Figure 15:
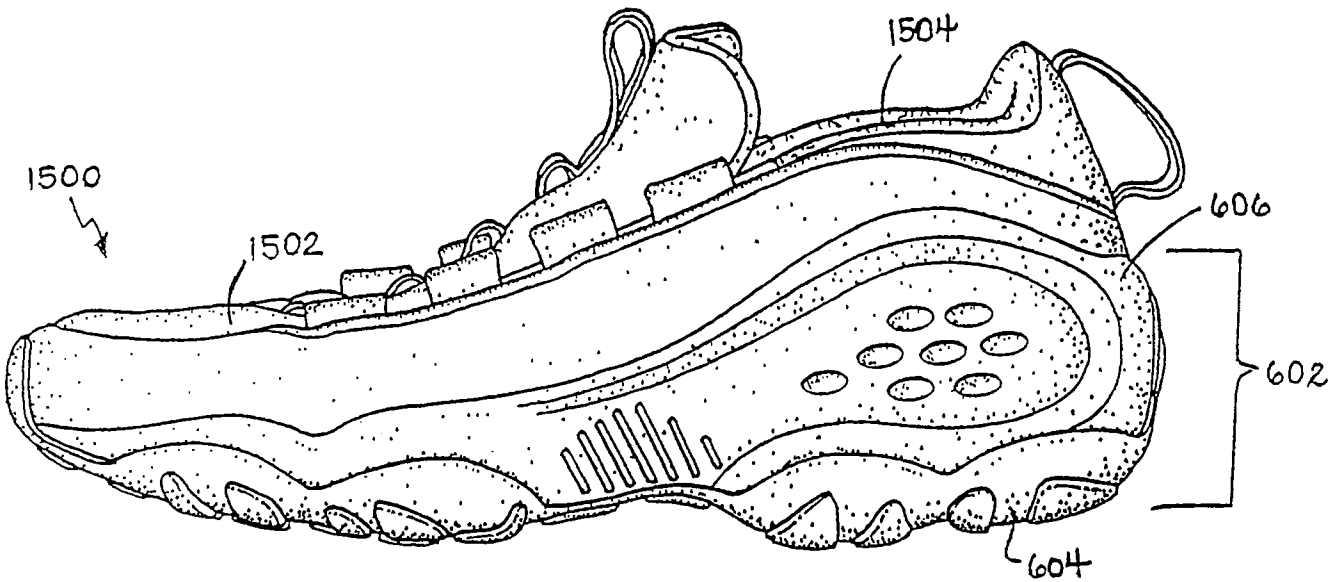
FIG. 15 is a perspective view of a shoe of the present invention.

An article of footwear incorporating the present invention is now described. Resilient insert 102 and bladder 1002 are disposed within an article of footwear 1500, shown in FIG. 15. Article of footwear 1500 includes a sole 602 including outsole 604 and midsole 606. Resilient insert 102 is disposed between outsole 604 and midsole 606. Although resilient insert 102 is not visible in FIG. 15, in the preferred embodiment, outsole 604 is made from a clear rubber material so that resilient insert 102 is visible. Further, bladder 1002 (not visible in FIG. 15) is disposed between midsole 606 and lasting board 1302 (not visible in FIG. 15). An upper 1502 is attached to sole 602. Upper 1502 has an interior portion 1504. The insole is disposed in interior portion 1504.

In order to fully appreciate the cushioning effect of the present invention, the operation of the present invention will now be described in detail. When stationary, the foot of a wearer is cushioned by bladder 1002. Although the maximum thickness of bladder 1002, is approximately 0.2 inch (5 mm) above the top surface of midsole 606, the bladder produces an unexpectedly high cushioning effect. In one embodiment, bladder 1002, made by RF welding, is between 0.08-0.12 inch (2-3 mm). If bladder 1002 is blow molded, it may be as thick as 0.28-0.31 inch (7-8 mm) when manufactured, and is partially recessed in midsole 606.

When the wearer begins a stride, the heel of the wearer's foot typically impacts the ground first. At this time, the weight of the wearer applies downward pressure on heel portion 103 of resilient insert 102, causing heel chambers 104-112 of heel portion 103 to be forced downwardly.

The configuration of periphery passages 136 between heel chambers 104-112 can help compensate for the problem of pronation, the natural tendency of the foot to roll inwardly after heel impact. During a typical gait cycle, the main distribution of forces on the foot begins adjacent the lateral side of the heel during the "heel strike" phase of the gait, then moves toward the center axis of the foot in the arch area, and then moves to the medial side of the forefoot area during "toe-off." The configuration of heel chambers 104-112 is incorporated within resilient insert 102 to ensure that the air flow within resilient insert 102 complements such a gait cycle.

Referring to FIG. 1, it has been previously noted that periphery passages 136 within heel portion 103 essentially divide heel portion 103 into two regions: medial region 140 and lateral region 142. The downward pressure resulting from heel strike causes air within resilient insert 102 to flow from medial region 140, including heel chambers 108 and 110, into lateral region 142, including heel chambers 104, 106 and 112. Thus, medial region 142, is cushioned first to prevent the wearer's foot from rolling inwardly. Further compression of heel portion 103 causes the air in lateral region 142 to be forced forwardly, through central connecting passage 124, into forefoot portion 113.

The velocity at which the air flows between heel chambers 104-112 and forefoot chambers 114-122 depends on the structure of central connecting passage 124 and, in particular, the structure of impedance means 126 and 128.

The flow of air into forefoot portion 113 causes forefoot chambers 114-122 to expand, which slightly raises the forefoot or metatarsal area of the foot. It should be noted that when forefoot chambers 114-122 expand, they assume a somewhat convex shape. When the forefoot of the wearer is placed upon the ground, the expanded forefoot chambers 114-122 help cushion the corresponding impact forces. As the weight of the wearer is applied to the forefoot, the downward pressure caused by the impact forces causes forefoot chambers 114-122 to compress, forcing the air therein to be thrust rearwardly through connecting passage 124 into heel portion 103. Once again, the velocity at which the air flows from forefoot chambers 114-122 to heel chambers 104-112 will be determined by the structure of impedance means 126 and 128.

After "toe-off," no downward pressure is being applied to the article of footwear, so the air within resilient insert 102 should return to its normal state. Upon the next heel strike, the process is repeated.

In light of the foregoing, it will be understood that resilient insert 102 of the present invention provides a variable, non-static cushioning, in that the flow of air within resilient insert 102 complements the natural biodynamics of an individual's gait.

Because the "heel strike" phase of a stride or gait usually causes greater impact forces than the "toe-off" phase thereof, it is anticipated that the air will flow more quickly from heel portion 103 to forefoot portion 113 than from forefoot portion 113 to heel portion 103. Similarly, impact forces are usually greater during running than walking. Therefore, it is anticipated that the air flow will be more rapid between the chambers during running than during walking.

The foregoing description of the preferred embodiment has been presented for purposes of illustration and description. It is not intended to be exhaustive or to limit the invention to the precise form disclosed, and obviously many modifications and variations are possible in light of the above teachings. For example, it is not necessary that resilient insert 102, especially heel portion 103, forefoot portion 113 and connecting passage 124 thereof, be shaped as shown in the figures. Chambers of other shapes may function equally as well.

Figure 16:
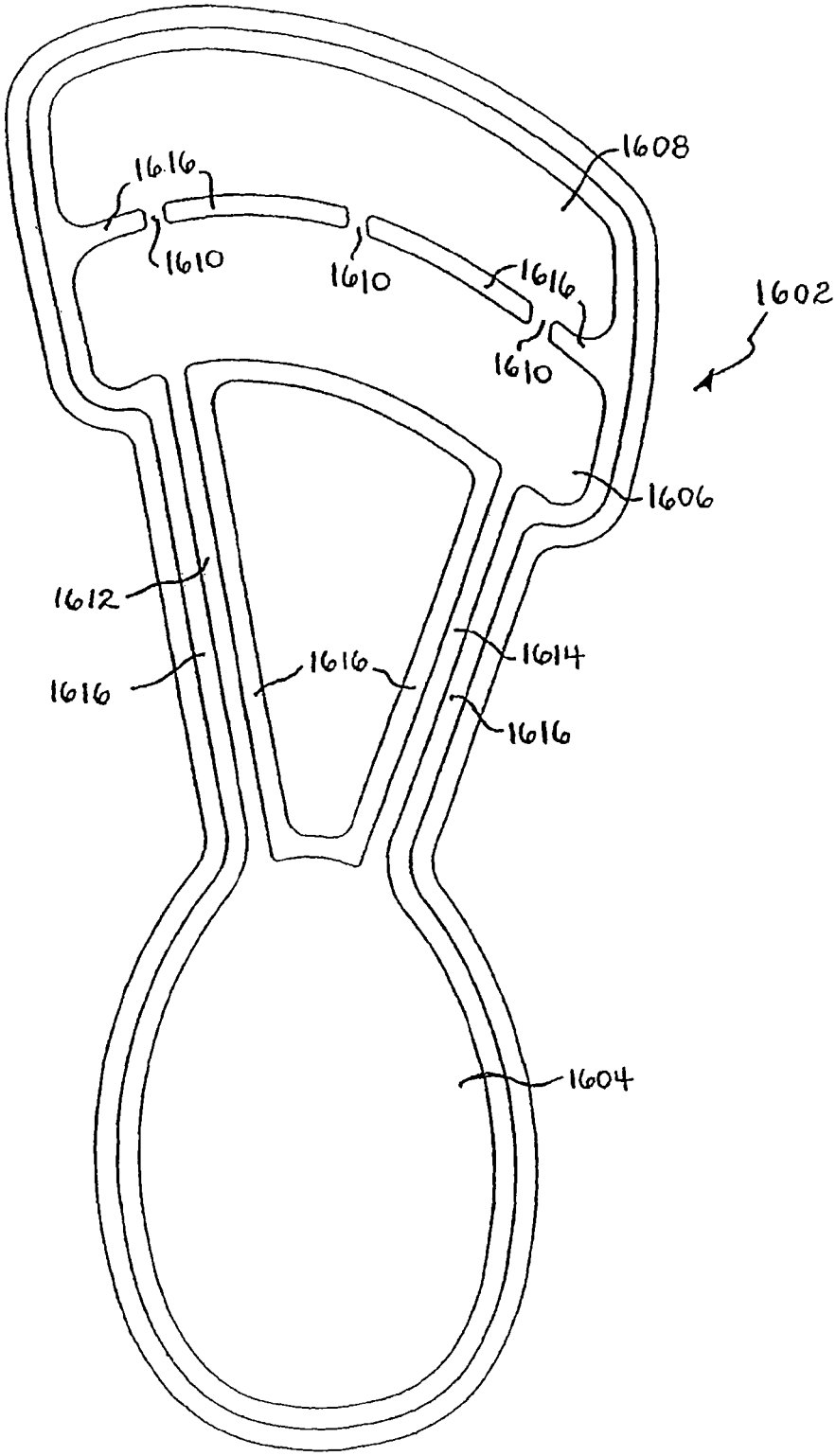
FIGS. 16-18 show alternate embodiments of bladders of the present invention.
Figure 17:
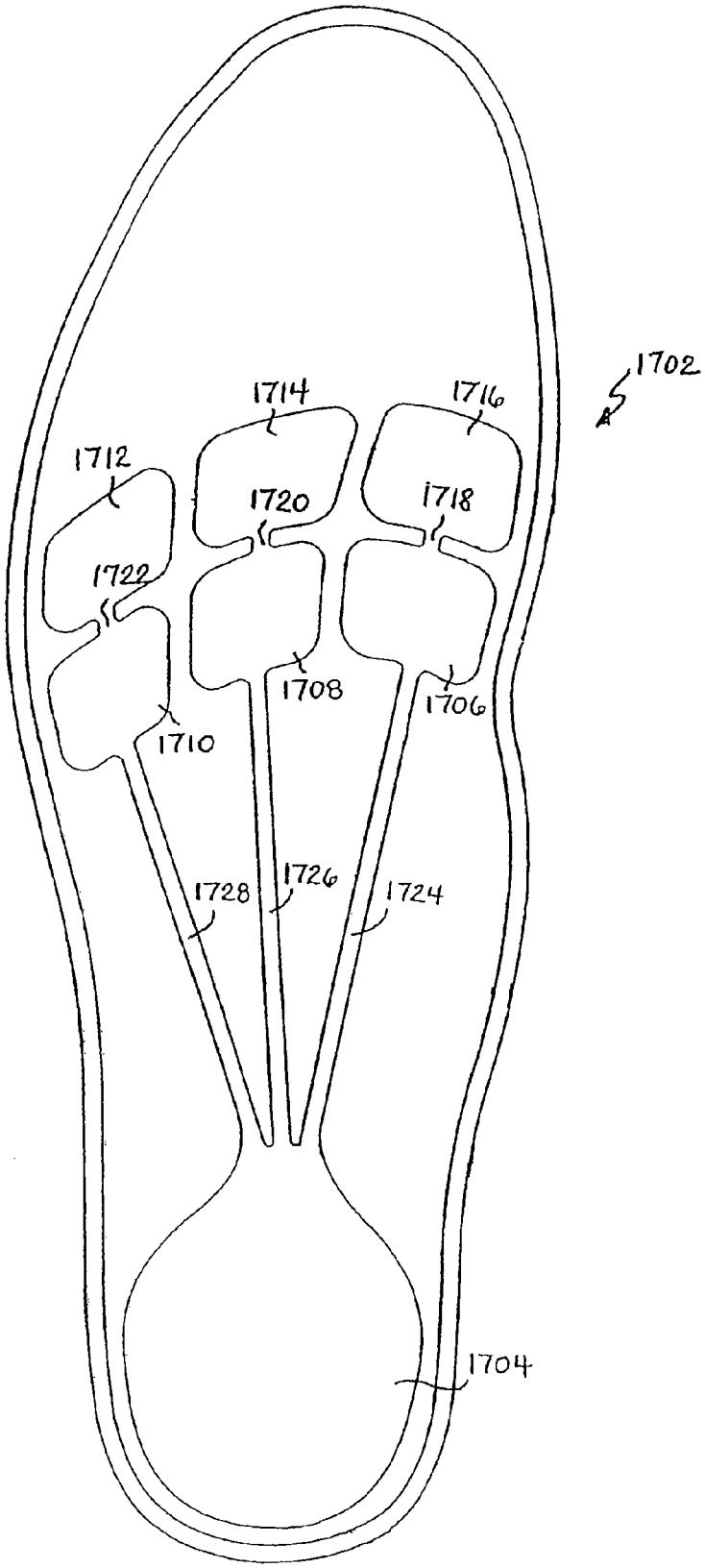
Figure 18:
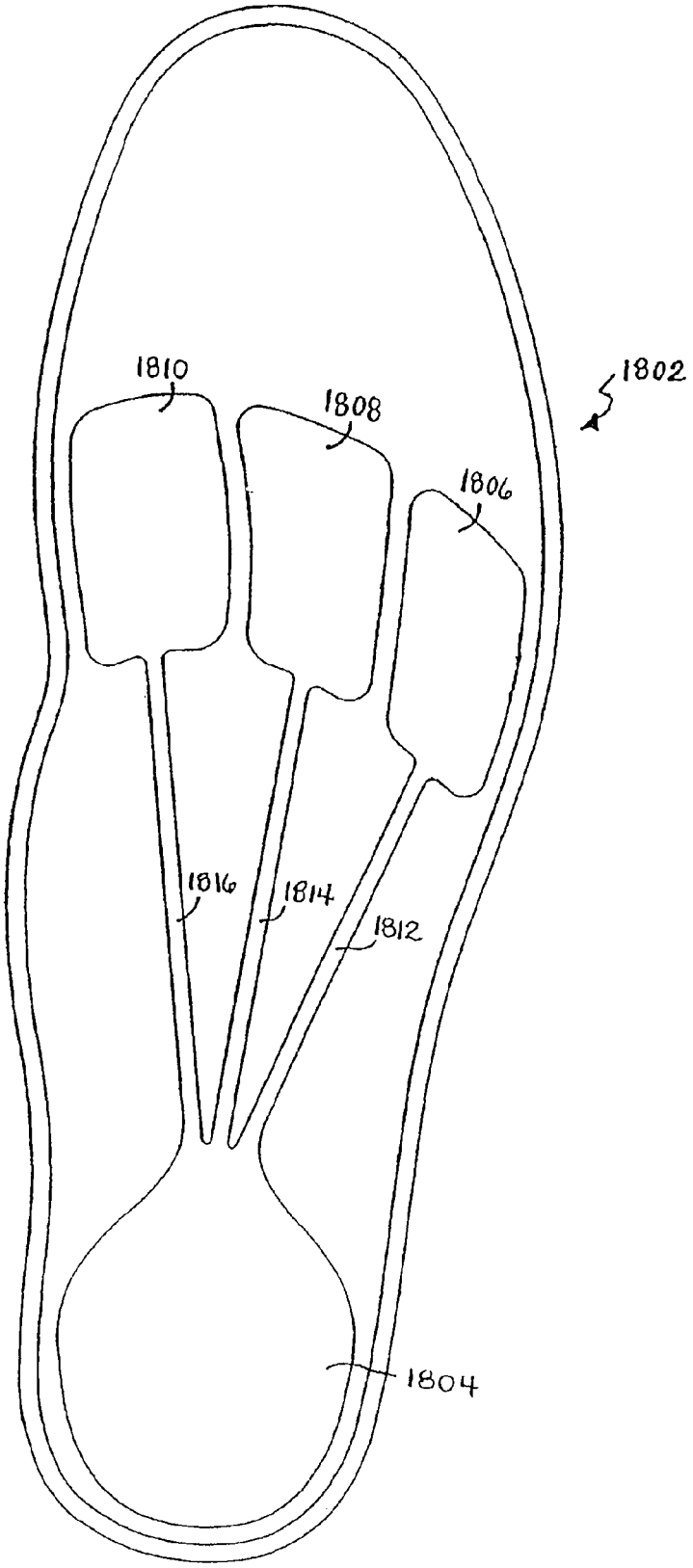

Similarly, it is not necessary that bladder 1002 be shaped as shown in FIG. 10. For example, FIGS. 16-18 show alternate embodiments of the bladder of the present invention. All three of these bladders are formed by thermoforming, as described above with respect to bladder 1002, and contain air at slightly above ambient pressure.

FIG. 16 shows a second embodiment of a bladder 1602 of the present invention. Bladder 1602 has a rear chamber 1604, a first front chamber 1606 and a second front chamber 1608. First and second front chambers 1606 and 1608 are connected via small passages 1610 formed by weld lines 1616. Bladder 1602 has connecting passages 1612 and 1614 formed by weld lines 1616, identical to bladder 1002. Connecting passages 1612 and 1614 connect rear chamber 1604 and first front chamber 1606.

FIG. 17 shows a third embodiment of a bladder 1702 of the present invention. Bladder 1702 has a rear chamber 1704 and a plurality of front chambers 1706, 1708, 1710, 1712, 1714 and 1716. Front chamber 1706 and 1716 are connected via a small passage 1718. Similarly, front chambers 1708 and 1714 are connected via a small passage 1720 and front chambers 1710 and 1712 are connected via a small passage 1722. Bladder 1702 has connecting passages 1724, 1726 and 1728. Connecting passage 1724 connects rear chamber 1704 and front chamber 1706. Similarly, connecting passage 1726 connects rear chamber 1704 and front chamber 1708, and connecting passage 1728 connects rear chamber 1704 and front chamber 1710.

FIG. 18 shows a fourth embodiment of a bladder 1802 of the present invention. Bladder 1802 has a rear chamber 1804 and a plurality of front chambers 1806, 1808 and 1810. Bladder 1802 has connecting passages 1812, 1814 and 1816. Connecting passage 1812 connects rear chamber 1804 and front chamber 1806. Similarly, connecting passage 1814 connects rear chamber 1804 and front chamber 1808, and connecting passage 1816 connects rear chamber 1804 and front chamber 1810.

With reference to FIGS. 1 and 5, it will be appreciated that resilient insert 102 comprises an insert which may be positioned within different areas of an article of footwear. Accordingly, although resilient insert 102 is shown as being positioned between outsole 604 and midsole 606 in FIG. 6, it is to be understood that resilient insert 102 may also be positioned within a cavity formed within a midsole or between a midsole and an insole. When positioned between a midsole and an outsole, resilient insert 102 may be visible from the exterior of the shoe. Further, it will be appreciated that the shoe in which resilient insert 102 is incorporated may be constructed so that resilient insert 102 is readily removable and may easily be replaced with another resilient insert. Accordingly, different resilient inserts can be inserted depending upon the physical characteristics of the individual and/or the type of activity for which the shoe is intended.

In addition to the above-noted changes, it will be readily appreciated that the number of chambers, the number or location of connecting passages 124, and/or the location of periphery passages 136 of resilient insert 102 may also be varied. For example, the chambers of resilient insert 102 may be divided such that resilient insert 102 has two cushioning systems which function independently of one another. In the preferred embodiment of FIG. 1, resilient insert 102 provides "multistage" cushioning, wherein the different chambers compress in sequence through the gait cycle.

An alternative embodiment would include valve means disposed adjacent connecting passage 124, in order to allow the flow rate to be adjusted. Another embodiment, would be to provide resilient insert 102 with at least two connecting passages 124 with each passage including an interior check-valve. The check valves could simply comprise clamping means formed within connecting passages 124. In such a construction, each connecting passage 124 would have a check valve to form a one-way passage such that air could only flow in one direction therethrough. An example of such a valve is provided in U.S. Pat. No. 5,144,708, which describes therein a one-way valve commonly referred to as a Whoopie valve, available from Dielectric, Industries, Chicopee, Mass. In one example, fluid may flow from heel portion 103 to forefoot portion 113 through a first connecting passage, and from forefoot portion 113 to heel portion 103 via a second connecting passage. The air flow in this embodiment could thus be directed such that it mimics the typical gait cycle discussed above. Further, one of the connecting passages could include impedance means which provides laminar air flow, while the other communication chamber could include impedance means to provide turbulent air flow.

Although two differently-shaped impedance means are shown in the accompanying drawings, other shapes will also serve to provide support and cushioning to resilient insert 102 of the present invention. The shape of impedance means 126 and 128 will directly affect the velocity of the air as it travels within resilient insert 102.

The mass flowrate of air within the resilient insert of the present invention is dependent upon the velocity of the heel strike (in the case of air traveling from the heel chamber to the forefoot chamber). Further, the size and structure of the impedance means of the present invention directly affects the impulse forces exerted by the air moving within the chambers of the resilient insert. With a given flowrate, the size and structure of the impedance means will dramatically affect the velocity of the air as it travels through the impedance means. Specifically, as the cross-sectional area of the impedance means becomes smaller, the velocity of the air flow becomes greater, as do the impulse forces felt in the forefoot and heel chambers.

As discussed herein, in one embodiment of the present invention, ambient air is disposed within resilient insert 102. However, in an alternate embodiment of the present invention, pressurized air may be disposed within resilient insert 102. For example, in order to keep forefoot and heel portions 113, 103 slightly convex, a slight pressure (approximately 1-4 psi above ambient pressure) may be introduced into resilient insert 102 when sealing the member closed. Further, it will be appreciated that other fluid mediums, including liquids and large molecule gases, may be disposed within resilient insert 102 and provide the desired support and cushioning thereto. If a fluid medium other than ambient air is used, the structure of the impedance means may be modified in order to effectively provide the character of fluid flow desired.

It is anticipated that the preferred embodiment of resilient insert 102 of the present invention will find its greatest utility in athletic shoes (i.e., those designed for walking, hiking, running, and other athletic activities).

While the invention has been particularly shown and described with reference to preferred embodiments thereof, it will be understood by those skilled in the art that various changes in form and details may be made therein without departing from the spirit and scope of the invention.

What is claimed is:

1. An article of footwear, comprising:

a sole having a forefoot portion and a heel portion, said sole comprising a midsole, an intermediate sole, and a ground contacting surface; and an indentation formed in said midsole, wherein a portion of said intermediate sole is disposed in said indentation and a portion of said intermediate sole extends from said midsole and below at least a portion of said ground contacting surface, such that a forefoot bulge extends out from the forefoot portion of said ground contacting surface and a heel bulge extends out from the heel portion of said ground contacting surface.

2. The article of footwear of claim 1, wherein at least half of said intermediate sole extends from said midsole.

3. The article of footwear of claim 1, wherein at least half of said intermediate sole extends from said indentation.

4. The article of footwear of claim 1, wherein at least half of said intermediate sole extends from said midsole in the forefoot portion and the heel portion.

5. The article of footwear of claim 1, wherein said indentation is concave.

6. The article of footwear of claim 1, wherein said intermediate sole comprises a resilient insert.

7. The article of footwear of claim 6, wherein the resilient insert contains air at ambient pressure.

8. The article of footwear of claim 6, wherein the resilient insert comprises at least one forefoot chamber and at least one heel chamber in fluid communication with the at least one forefoot chamber.

9. The article of footwear of claim 6, wherein the resilient insert comprises a plurality of forefoot chambers and a plurality of heel chambers.

10. An article of footwear, comprising:

a sole having a forefoot portion and a heel portion, said sole comprising a midsole, an intermediate sole having an intermediate sole forefoot bulge and an intermediate sole heel bulge defining a bottom surface thereof, and an outsole having a ground contacting surface, wherein at least a portion of said intermediate sole is disposed in said midsole and said intermediate sole forefoot bulge and heel bulge extend from said midsole, wherein the outsole conforms to the intermediate sole forefoot bulge and heel bulge to form an outsole forefoot bulge extending from the forefoot portion of said ground contacting surface and an outsole heel bulge extending from the heel portion of said ground contacting surface.

11. The article of footwear of claim 6, further comprising an indentation formed in said midsole.

12. The article of footwear of claim 11, wherein at least a portion of said intermediate sole is disposed in said indentation and at least half of said intermediate sole extends from said indentation.

13. The article of footwear of claim 10, further comprising a cavity formed in said midsole.

14. The article of footwear of claim 13, wherein at least a portion of said intermediate sole is disposed in said cavity and at least half of said intermediate sole extends from said cavity.

15. The article of footwear of claim 10, wherein said intermediate sole comprises a resilient insert.

16. The article of footwear of claim 15, wherein the resilient insert comprises at least one forefoot chamber and at least one heel chamber in fluid communication with the at least one forefoot chamber.

17. The article of footwear of claim 16, wherein the resilient insert comprises a plurality of forefoot chambers and a plurality of heel chambers.

18. An article of footwear, comprising:

a sole having a forefoot portion and a heel portion, said sole comprising:

a midsole having a concave indentation formed therein, an outsole having a concave indentation formed therein, wherein a periphery of the outsole indentation mates with a periphery of the midsole indentation to define a cavity therebetween, a resilient insert disposed in the cavity, said resilient insert having a forefoot chamber, a heel chamber, and a passageway fluidly connecting the forefoot chamber and the heel chamber, and a ground contacting surface, wherein the forefoot chamber conforms to the shape of the midsole indentation and the outsole indentation to form a forefoot bulge extending from the forefoot portion of said ground contacting surface and wherein the heel chamber conforms to the shape of the midsole indentation and the outsole indentation to form a heel bulge extending from the heel portion of the ground contacting surface.

19. The article of footwear of claim 18, wherein at least half of said resilient insert extends from the midsole indentation.

20. The article of footwear of claim 18, wherein at least half of the forefoot chamber extends from the midsole indentation and at least half of the heel chamber extends from the midsole indentation.

21. The article of footwear of claim 18, wherein the resilient insert contains air at ambient pressure.

22. The article of footwear of claim 18, wherein the forefoot bulge and the heel bulge are convex.

23. The article of footwear of claim 18, wherein said midsole is foam.

24. The article of footwear of claim 18, wherein the midsole indentation curves in a toe-to-heel direction, and wherein the outsole indentation curves in a toe-to-heel direction.

* * * * *

UNITED STATES PATENT AND TRADEMARK OFFICE

CERTIFICATE OF CORRECTION

PATENT NO. : 8,434,244 B2
APPLICATION NO. : 12/351135
DATED : May 7, 2013
INVENTOR(S) : Paul E. Litchfield It is certified that error appears in the above-identified patent and that said Letters Patent is hereby corrected as shown below:

1. On the Title page, Item (63), under the heading Related U.S. Application Data: "which is a continuation-in-part of application No. 08/599,100, filed on Feb. 9, 1996, now abandoned, which is a continuation of application No. 08/284,646, filed as application No. PCT/US94/00895 on Jan. 26, 1994, now abandoned" should be deleted.

In the Claims:

2. In column 14, line 62 (claim 11): "The article of footwear of claim 6, further" should be replaced with --The article of footwear of claim 10, further--.

Signed and Sealed this
Thirteenth Day of August, 2013

Teresa Stanek Rea
*Acting Director of the United States Patent and Trademark Office*